US005864901A

United States Patent [19]

Blümel

[11] Patent Number: 5,864,901

[45] Date of Patent: Feb. 2, 1999

[54] APPARATUS FOR SUPPORTING AN INDIVIDUAL IN SELECTIVELY ADJUSTABLE ORIENTATIONS

[75] Inventor: Georg Blümel, Leipzig, Germany

[73] Assignee: Bavaria Patente und Lizenzen Verwer-Tungsgesellschaft MBH, Kreischa, Germany

[21] Appl. No.: 844,407

[22] Filed: Apr. 18, 1997

[30] Foreign Application Priority Data

Apr. 18, 1996 [DE] Germany ..... 196 15 391.3

[51] Int. Cl.[6] ..... A61G 7/005

[52] U.S. Cl. ..... 5/610; 5/623; 5/600

[58] Field of Search ..... 5/610, 623, 601, 5/600; 378/209

[56] References Cited

U.S. PATENT DOCUMENTS

| | | | |
|---|---|---|---|
| 3,434,165 | 3/1969 | Keane | 5/610 X |
| 3,805,080 | 4/1974 | Yager et al. | 5/610 X |
| 3,997,926 | 12/1976 | England | 5/610 |
| 4,164,656 | 8/1979 | Krasznai et al. | 5/610 X |
| 5,014,292 | 5/1991 | Siczek et al. | 5/601 X |
| 5,020,170 | 6/1991 | Ruf . | |
| 5,230,113 | 7/1993 | Foster et al. | 5/610 X |
| 5,299,334 | 4/1994 | Gonzalez | 5/610 X |

FOREIGN PATENT DOCUMENTS

| | | |
|---|---|---|
| 349 945 | 1/1990 | European Pat. Off. . |
| 1 709 972 | 11/1955 | Germany . |
| 1 809 992 | 3/1960 | Germany . |
| 1 566 447 | 1/1970 | Germany . |
| 1 791 263 | 12/1973 | Germany . |
| 25 52 488 | 10/1977 | Germany . |
| 88 03 723 U1 | 6/1988 | Germany . |
| 3808 184 A1 | 9/1988 | Germany . |
| 39 15 420 | 11/1990 | Germany . |
| 449 848 | 4/1968 | Switzerland . |
| 883 964 | 12/1961 | United Kingdom . |

*Primary Examiner*—Michael F. Trettel
*Attorney, Agent, or Firm*—Leydig, Voit & Mayer, Ltd.

[57] ABSTRACT

An apparatus for supporting an individual in selectively adjustable orientations is provided. The apparatus includes a base member and at least one support member which is pivotally attached to the base member. The support member is rotatable about an axis defined by its pivotal connection to the base member such that the position or orientation of the support member is selectively adjustable relative to the base member. The device also includes a mechanism for driving the rotation of the support member about the axis and a control unit which controls the operation of the driving mechanism.

32 Claims, 6 Drawing Sheets

APPARATUS FOR SUPPORTING AN INDIVIDUAL IN SELECTIVELY ADJUSTABLE ORIENTATIONS

FIELD OF THE INVENTION

This invention generally relates to an apparatus for supporting an individual and, more particularly, to an apparatus for supporting an individual in selectively adjustable orientations.

BACKGROUND OF THE INVENTION

In the context of medical treatment it often is necessary to regularly change the orientation of a bed-ridden patient. For example, changing the orientation of a bed-ridden patient can be helpful in preventing the patient from developing bed sores or from lapsing into a comatose condition. It may also be used to help stimulate the patient's circulation. With conventional hospital beds, however, changing the orientation of a patient must be done manually and is therefore quite labor intensive and costly.

A "bed" which allows for automatic adjustment of the orientation of a patient is disclosed in DE 3,915,420 A1. With the disclosed "bed" a patient is placed within a rigid shell which is equipped with inflatable air chambers. In order to enable the orientation of the patient to be adjusted, the shell can be rotated by a pair of engine driven axles. As the shell is rotated, the inflatable air chambers support the body of the patient, thereby preventing the possibility of injury. The inflatable air chambers, however, limit air circulation within the shell and make it difficult for the patient to breathe. Moreover, the noise and vibration caused by the engines which rotate the shell can make the bed quite uncomfortable. Thus, this type of apparatus is particularly ill-suited for use in the context of medical treatment.

OBJECTS AND SUMMARY OF THE INVENTION

Accordingly, a primary object of the invention is to overcome the deficiencies of existing equipment of this general type.

It is an additional object of the present invention to provide an apparatus for supporting an individual that is capable of supporting the individual in selectively adjustable orientations and which is suitable for use in a medical environment.

It is an additional object of the present invention to provide an apparatus for supporting an individual which is capable of comfortably supporting individuals of varying size in selectively adjustable orientations.

It is a further object of the present invention to provide an apparatus for supporting an individual which can be adjusted quite easily into the various orientations.

The present invention provides these and other features and advantages with an apparatus for supporting an individual, such as a patient, in selectively adjustable orientations. The apparatus includes a base and at least one support member, which in a preferred embodiment comprises a bed, that is pivotally attached to the base member via a pivot pin. The bed is rotatable about an axis defined by its pivotal connection to the base member such that the position or orientation of the bed is selectively adjustable relative to the base. Thus, the orientation of a patient who is being supported by the bed may be varied simply by rotating the bed relative to the base of the apparatus. In a preferred embodiment, the bed further includes head and foot rests which are adjustable relative to the bed in order to enhance the support and comfort of the patient. In addition, the bed may also include a step support, arm supports and shoulder supports each of which is adjustable relative to the bed in order to comfortably secure the patient to the support apparatus both when it is moving between positions and when it is retaining the patient in a selected position.

In order to provide for the selective rotation of the bed, the apparatus includes a drive mechanism. In a preferred embodiment, the drive mechanism includes a arcuate shaped carriage which is attached to the underside of the bed. A flexible drive belt traverses the outer surface of the carriage and engages at least one drive roller which, in turn, is driven by an electric motor. The apparatus may also be equipped with a control system which operates the drive mechanism such that it automatically adjusts the orientation of the patient to a particular position based upon either a predetermined program or a measurement of preselected medical characteristics of the patient.

In an another embodiment of the present invention, the support apparatus may be equipped with at least one arm support which has an associated leveling mechanism which ensures that the arm support remains in a horizontal position when the bed member is rotated.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Generally the present invention relates to an apparatus which includes one or more support members which are rotatable about an axis such that the orientation of an individual, such as for example a patient, may be selectively adjusted. The support members are rotated by drive mechanisms which may have associated controllers permitting automatic adjustment of the orientation of the patient based on a predetermined program or based on a measurement of selected medical characteristics of the patient, such as for example brain waves, heart frequency, or blood pressure. Moreover, the support members may be adjustable in order to ensure the comfort of patients of different heights and sizes. The support elements are also arranged such that the air flow to and from the patient is unobstructed so as to ensure that the patient is properly ventilated and that the apparatus does not interfere with the patient's breathing.

Figure 1:
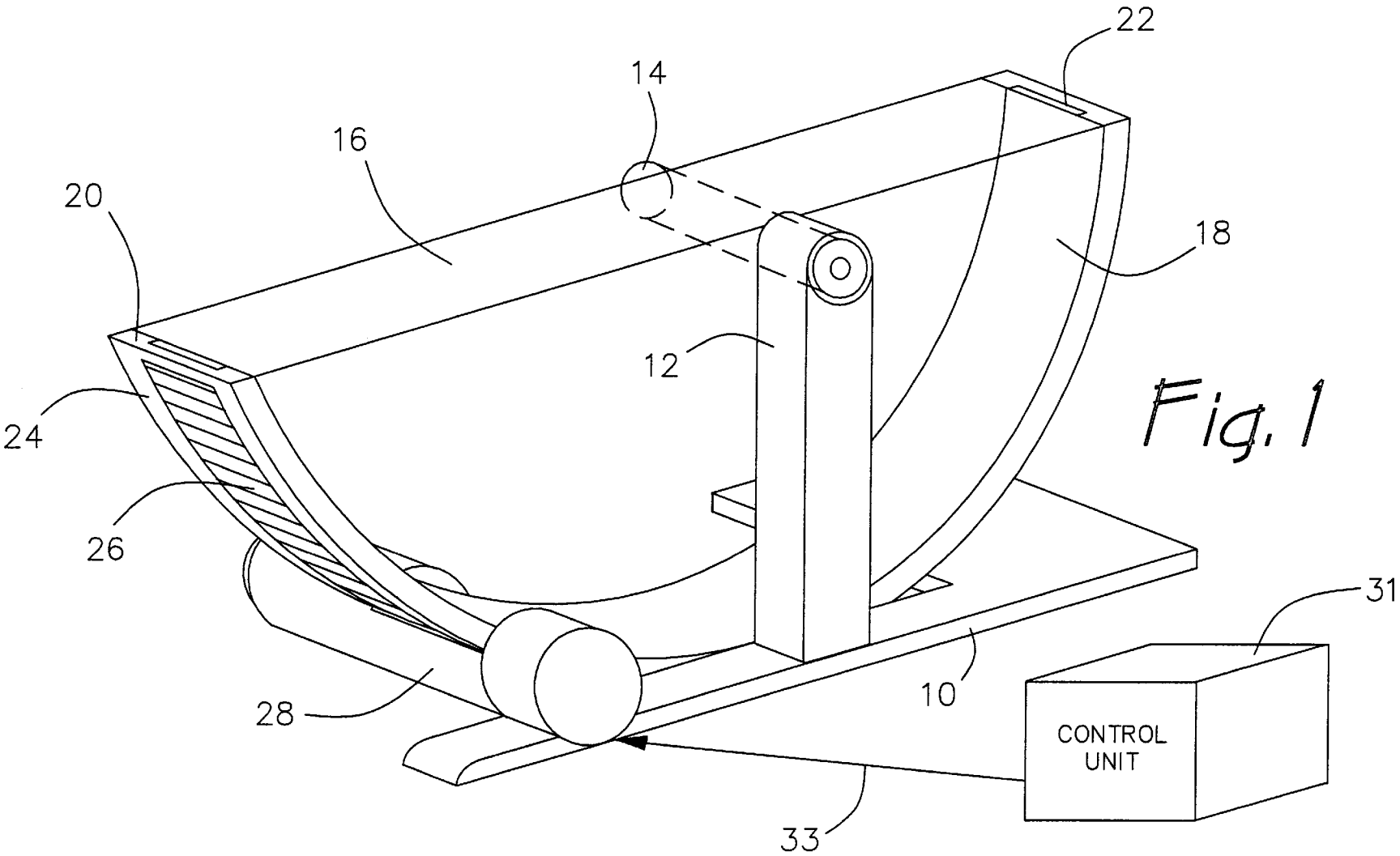
FIG. 1 is a partially cut-away perspective view of an apparatus for supporting an individual in selectively adjustable orientations constructed according to one embodiment of the present invention.

FIGS. 1–4 illustrate one embodiment of an adjustable support apparatus constructed in accordance with the present invention. As shown in FIG. 1, the support apparatus includes a base member 10 having an attached upwardly extending arm 12. A main support member 16, which in the illustrated embodiment comprises a bed, is pivotally attached to the upper end of the arm 12 by a pivot pin 14. The bed 16 is rotatable relative to the arm 12 and base 10 about an axis defined by pivot pin 14 into any desired angular position relative to the arm 12. In this manner, the orientation of the patient relative to the arm 12 and the base member 10 may be varied.

In order to provide for the selective rotation of the bed 16, the support apparatus of the present invention includes a drive means or mechanism that includes an arcuate-shaped carriage 18 having a central axis which is coaxial with pivot pin 14. The carriage 18 is attached to the upper and lower ends 20, 22 of the bed 16. A flexible notched drive belt 26 traverses the outer surface 24 of the arcuate carriage 24. A housing 28 which includes drive elements that engage the drive belt 26, thereby enabling selective rotation of the carriage 18 and, in turn, the bed 16, is attached to the base member 10 such that it is arranged outside of the circumferential surface 24 of the carriage 18.

Figure 2:
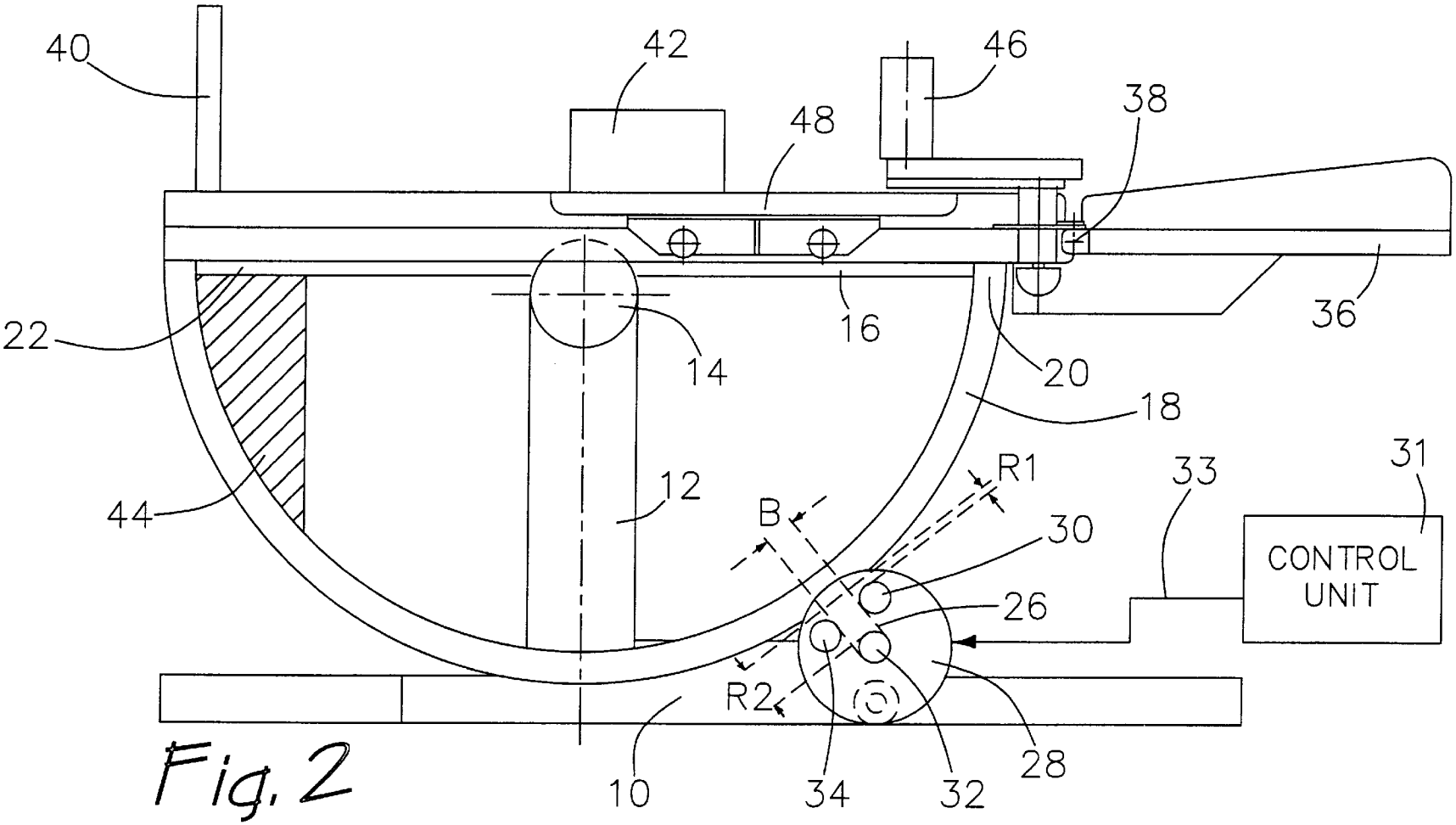
FIG. 2 is a partially cut away side elevation view of an apparatus for supporting an individual in selectively adjustable orientations constructed according to one embodiment of the present invention.

In the illustrated embodiment, the drive mechanism also includes three deflection rollers at least one of which is provided with teeth complementary to the drive belt notches and is attached to a drive mechanism disposed to rotate the roller, for example an electric motor (not shown), such that it acts as a drive roller. In particular, as shown in FIG. 2, the deflection rollers are arranged such that first and second deflection rollers 30, 34 guide the drive belt 26 as it is pulled away from the carriage 18 and around a portion of the surface of a third deflection roller 32 which is spaced a greater radial distance from the arcuate carriage 18 than the first and second deflection rollers 30, 34. With the arrangement of the deflection rollers shown in FIG. 2, preferably at least the third deflection roller 32 is attached to means for driving rotation of the roller.

The diameter of the deflection rollers and the position of each individual deflection roller relative to the carriage and the other deflection rollers are selected so as to ensure optimum operation of the drive mechanism including, for example, proper tension of the drive belt. In a preferred embodiment, all three of the deflection rollers 30, 32, 34 have the same diameter and the distance B along the circumferential surface of the carriage 18 between the first and second deflection rollers 30, 34 is approximately equal to the diameter of the deflection rollers. Moreover, the first and second deflection rollers 30, 34 are arranged as close as possible to the arcuate carriage 18 and each are spaced the same radial distance R1 away from the carriage. In this preferred embodiment, the third deflection roller 32 is centered relative to the first and second deflection rollers 30, 34 and spaced an radial distance R2 away from the carriage 18 which is larger than R1.

This preferred arrangement of the deflection rollers is particularly well suited for embodiments of the invention wherein only the third deflection roller 32 is arranged as a drive roller. Of course, those skilled in the art will readily appreciate that numerous other arrangements of the deflection rollers may be used including providing additional deflection rollers or arranging the deflection rollers inside the circumferential surface of the carriage. Moreover, other methods for driving the rotation of the carriage and the bed may be employed including, for example, a chain drive or a flat belt drive or the carriage itself may be equipped with teeth thereby eliminating the need for a drive belt.

Figure 3:
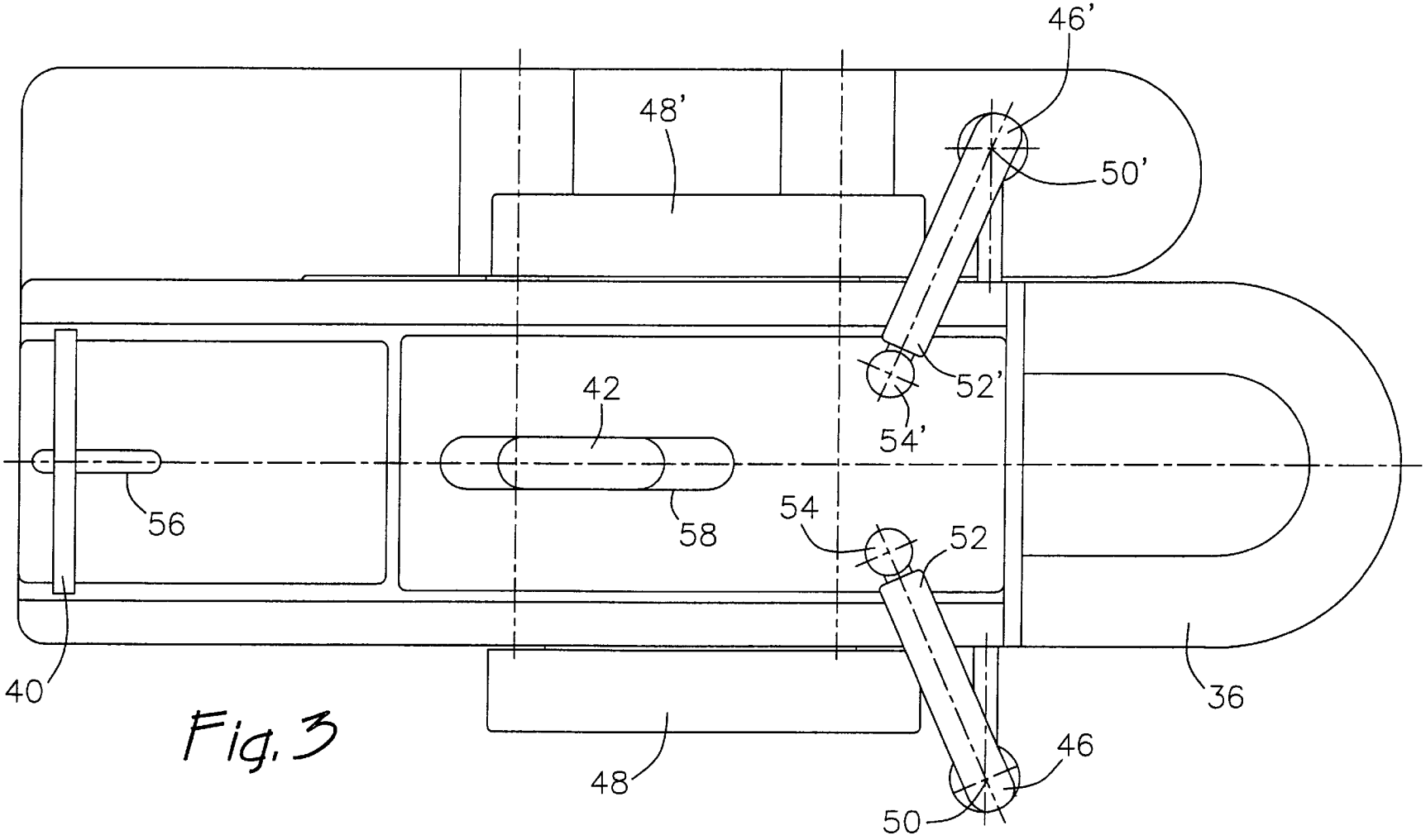
FIG. 3 is a top view of the support apparatus of FIG. 2.

In order to enhance the support and comfort of the patient, the bed 16 may include additional support elements such as head and foot rests 36, 40, shoulder supports 46, arm supports 48 and a step support 42. All of these additional support elements would of course rotate with the bed 16 around pivot pin 14. However, they also may be independently adjustable such that the support apparatus can easily accommodate patients of varying sizes. As shown in FIGS. 2 and 3, a padded head rest 36 is pivotally attached to the upper end 20 of the bed 16 by a pivot pin 38. The pivot pin 38 allows the angle of the head rest 36 relative to the bed 16 to be independently adjusted. The head rest 36 may also be connected to means, such as an electric motor, which drives the rotation of the head rest 36 about the pivot pin 38 as desired. A padded foot rest 40 may also be provided at the lower end 22 of the bed 16. As shown in FIG. 3, in order to accommodate patients of different heights, the bed 16 includes a guide slot 56 which allows the foot rest 40 to be adjusted in the longitudinal direction relative to the bed 16. As with the head rest 36, the adjustment of the foot rest 40 may be powered by a drive means such as an electric motor.

Figure 4:
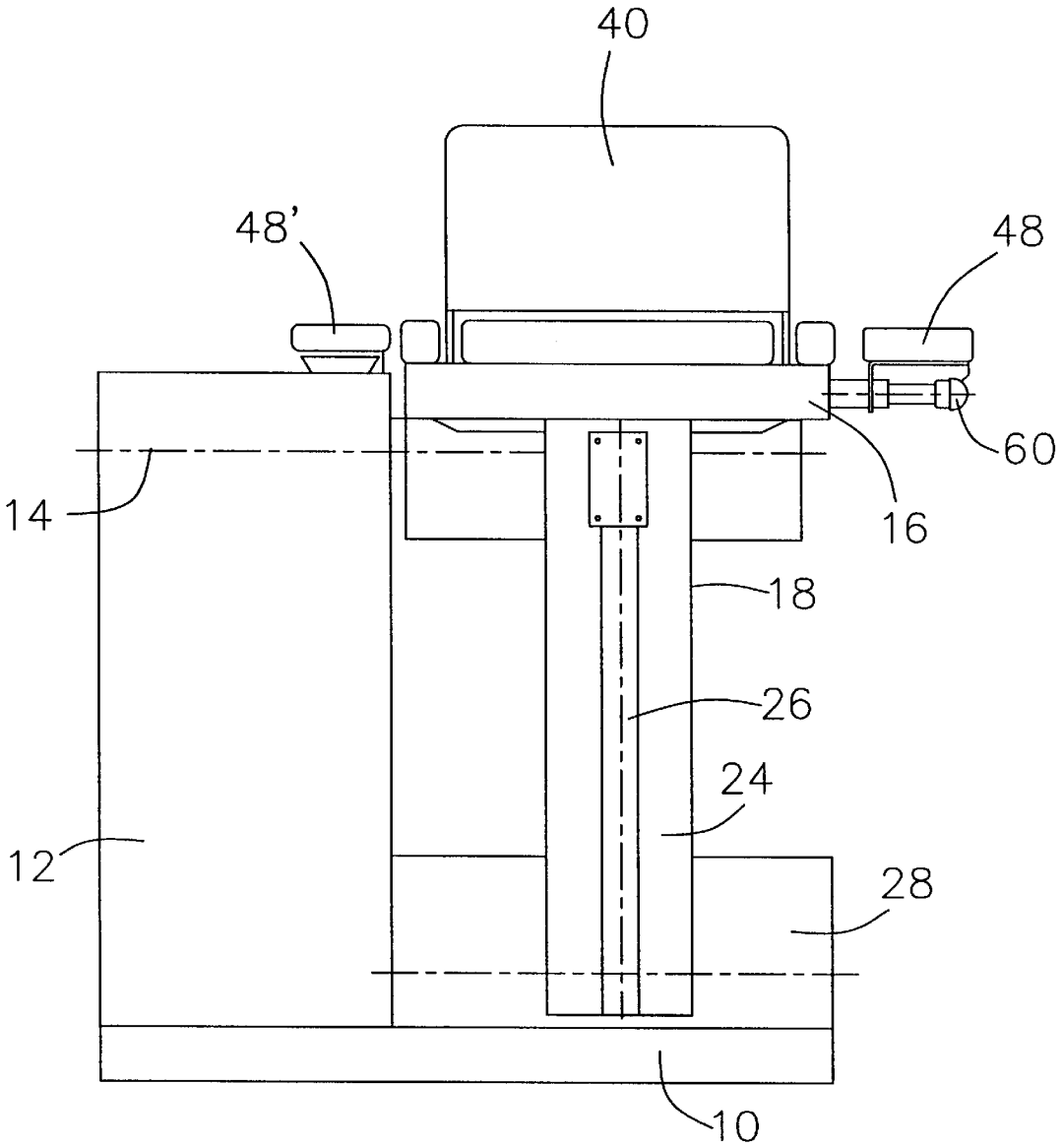
FIG. 4 is a front elevation view of the support apparatus of FIG. 2.

The bed 16 may also include a step support 42, arm supports 48 and shoulder supports 46 which aid in comfortably securing the patient to the support apparatus both when it is moving between positions and when it is retaining the patient in a selected position. As best shown in FIGS. 3 and 4, a pair of arm supports 48, 48' are attached to opposite sides of the bed 16 via pins 60. The pins 60 allow for easy attachment and removal of the arms supports 48, 48' as desired.

A pair of adjustable shoulder supports 46, 46' are also provided on the bed 16 as best shown in FIG. 3. In order to allow for adjustment of the shoulder supports 46, 46', one end of each shoulder support is pivotally attached to the bed 16 such that they are rotatable about an axis 50, 51 which is perpendicular to the plane of the bed 16. Moreover, an extendable support rod 52, 52' is provided at the opposite end of each shoulder support 46, 46' in order to enable the shoulder supports to be lengthened or shortened as desired. Once the support rods 52, 52' have been extended to the desired length, they may be locked in to position by locking pins or the like.

The bed 16 also includes an upwardly extending padded step support 42 which is disposed so as to engage the groin area of the patient and which in combination with the shoulder supports 46, 46' help to prevent the patient from moving in the longitudinal direction relative to the bed 16. In order to allow the step support 42 to be adjusted for patients of different heights, the step support 42 is movable within a guide slot 58 in the longitudinal direction relative to the bed 16, as shown in FIG. 3. As with the other adjustable elements, the rotation of the shoulder supports 46, 46' and the movement of the step support 42 may be driven by driving means such as electric motors. Those skilled in the art will appreciate that other types of and combinations or elements may be used to both support the body of the patient and secure the patient to the apparatus. For example, one or more safety belts may be provided on the bed 16 in order to secure the patient to the support apparatus.

In the illustrated embodiment of the support apparatus of the present invention, the center of gravity of the patient would not be positioned directly over the pivot pin 14, but rather it would be closer to the upper end 20 of the bed 16. In order to ensure that the carriage 18 and the bed 16, rotate smoothly, the carriage may be adapted such that counterweights 44 may be selectively added to the carriage 18 below the lower end of the bed 16 as shown in FIG. 2. In particular, sufficient counterweights 44 should be added so that the center of gravity of the bed 16 when it is supporting the patient is approximately above the pivot pin 14.

The need for someone to operate and monitor the support apparatus of the present invention may be lessened through the use of a system which automatically controls the operation of the driving means for the various support elements. A micro-processor based control system or control unit 31 is utilized to vary the orientation of the patient based upon a predetermined program which could be set up to move the patient into certain selected orientations at selected time intervals. For example, the predetermined program could be set-up such that the support apparatus could be used to perform circulation conditioning, a technique which is particularly important in treating older patients. Specifically, the program would control the various driving means such that a sequence of "change of position—pause—change of position—pause . . . " is provided. As a result, the control system applies signals on a line 33 to actuate the motor.

In an alternative embodiment, the control unit 31 may adjust the orientation of the patient based upon a measurement of a preselected medical characteristic. In particular, measuring devices could monitor such things as the patient's blood circulation, blood pressure, heart frequency, muscle potentials, brain waves or defined movements and provide a signal to the control system to adjust the orientation of the patient based upon these measured values. In the case where defined movements of the patient are monitored, the monitoring device could take the form of one or more ultrasound transmitters attached to specific body parts and receivers which would allow the position of the body part to be determined by conventional radiolocation techniques.

The use of measuring devices makes it possible for the support apparatus to react immediately to a potential medical crisis involving the patient. For example, if measurements are made which indicate that there is a danger that the patient will slip into a coma, the control unit 31 can automatically adjust the orientation of the patient since it is known that movement may help prevent a patient from slipping into a coma. In addition, the use of devices which measure defined movements could help severely handicapped persons in their use of the support apparatus of the present invention.

In certain situations, such as when the patient's blood pressure or circulation is being measured, it may be preferable to maintain at least one arm support in a predetermined orientation when the bed 16 is being rotated about pivot pin 14. Maintaining one of the patient's arms in a predetermined orientation, such horizontal and at the level of the heart, and using that arm to take measurements, enables the measuring device to generate readings that are comparable no matter what position the patient is in when the measurements are taken. In order to accomplish this with the embodiment of the invention shown in FIGS. 1–4, the arm supports 48, 48' would have to be readjusted after each rotation of the bed 16. Thus, it would be advantageous if the support apparatus of the present invention could be provided with an arm support which moves with the bed 16 as it is rotated, but which also remains in a horizontal position during the rotation.

Figure 5:
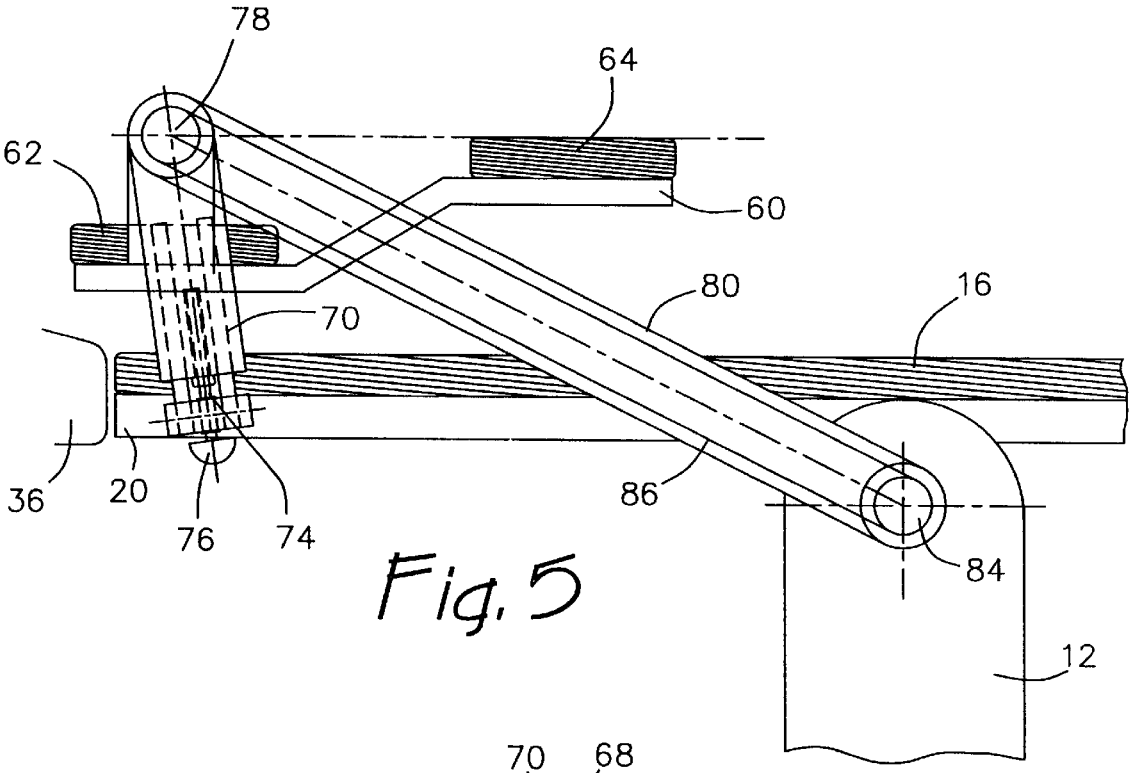
FIG. 5 is a partial side elevation view of an alternative embodiment of the support apparatus of the present invention showing an arm support leveling mechanism.
Figure 6:
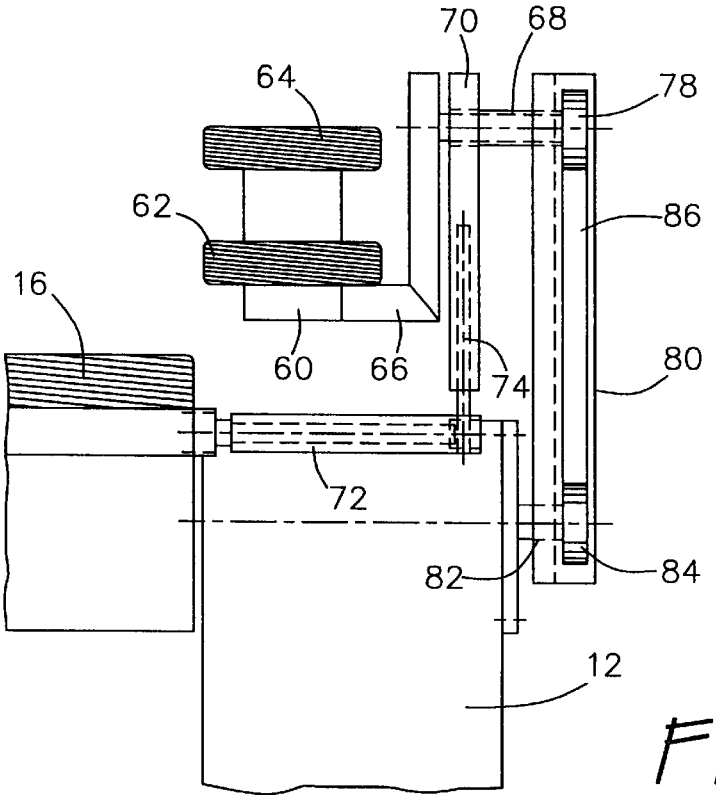
FIG. 6 is a partial front elevation view of the support apparatus of FIG. 5.

FIGS. 5–6 illustrate one embodiment of an arm support orientation maintenance means or mechanism which may be used with the support apparatus of the present invention. In this embodiment the arm support 60 includes two padded elements 62, 64 which are offset in height relative to each other. The first padded element 62 is positioned relatively lower and is designed to hold the elbow of the patient which should be slightly bent. The second padded element 64 is positioned higher relative to the first padded support 62 and is designed to hold the hand of the patient in a horizontal position with the lower arm of the patient angled upward.

As shown in FIG. 5, the arm support 60 is fixedly attached to an axle 68 via an angle member 66. The axle 68 in turn is rotatably supported in a vertical carrying element 70 which is firmly connected to the bed 16 by a horizontally arranged spacer 72. The carrying element 70 and the spacer 72 are connected together by a spindle drive 74 which may driven manually by an adjusting knob 76. The spindle drive 74 and its associated adjusting knob 76 enable the distance between the axle and the bed 16 to be adjusted as necessary according to the measurements of the patient.

A gear wheel 78 is attached to the free end of the axle 68 as shown in FIG. 5. The gear wheel 78 in turn is rotatably supported on or in one end of an elongate housing 80. The opposing end of the housing 80 is pivotally connected to the arm 12 by an axle 82 which is firmly connected to the arm 12. A second gear wheel 84 is rigidly attached to the free end of the axle 82. The second gear wheel 84 is stationary and is coaxial relative to the pivot pin 14. A second notched drive belt 86 runs around the two gear wheels 78, 84.

This mechanism ensures that the second padded element 64 remains in the horizontal position during rotation of the bed 16. For example, when the bed 16 is rotated from the horizontal position shown in FIG. 5 to a vertical position, the movement of the bed 16 causes the carrying element 70 which is attached to the bed to move along an arcuate path in the clockwise direction as established by FIG. 5. The movement of the carrying element 70, in turn, causes the drive belt 86 to move around the stationary gear wheel 84. This movement of the drive belt 86 around the stationary gear wheel 84 rotates the first gear wheel 78, thereby causing the arm support 60 to rotate in the counterclockwise direction as the bed 16 rotates in the clockwise direction. Thus, the second padded element 64 is maintained in the horizontal position during movement of the bed 16.

Figure 7:
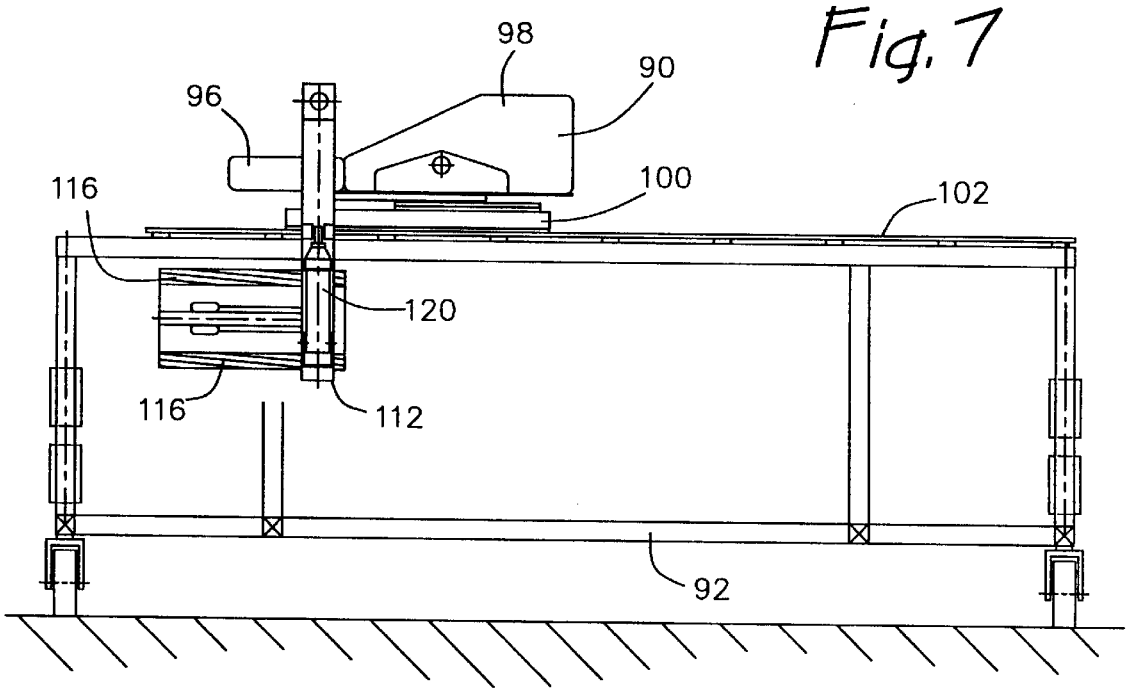
FIG. 7 is a partial side elevation view of another embodiment of the support apparatus of the present invention showing an arm support leveling mechanism.
Figure 8:
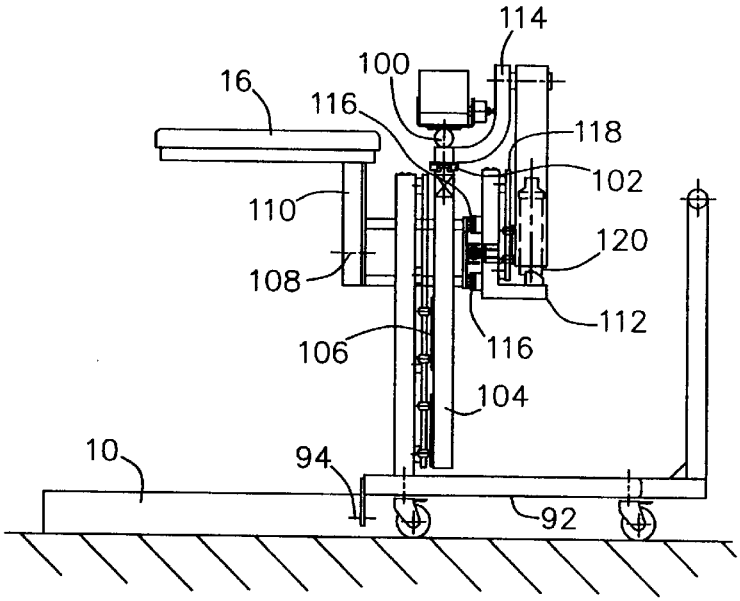
FIG. 8 is a partial front elevation view of the support apparatus of FIG. 7.

An alternative embodiment of an arm support orientation maintenance mechanism for use with the support apparatus of the present invention is shown in FIGS. 7 and 8. In the embodiment shown in FIGS. 7 and 8, the arm support 90 and its corresponding leveling mechanism are arranged on a wheeled cart or trailer 92 which enables the arm support 90 to be easily removed from the support apparatus when they are not needed. As shown in FIG. 8, when the arm support 90 is being used it is fixed relative to the support apparatus by an anchor element 94 which engages the base member 10. The arm support 90 has a similar configuration to the arm support 60 shown in FIGS. 5–6. Specifically, the arm support 90 includes a lower padded element 96 on which the elbow of the patient should be placed and an upper padding element 98 on which the patient's hand is placed. The arm support 90 is attached to a support bracket 100 which may be shifted along a horizontal guide track 102. The horizontal guide track 102 is attached to a second support bracket 104 which may be shifted along a vertical guide track 106.

A rotating movement of the bed 16 is transmitted to the arm support 90 via a coupling point 108 on an extension arm 110 attached to the underside of the bed 16, as shown in FIG. 8. At the coupling point 108, one end of a bracket member 112 is connected to the extension arm 110 via an axle (not shown). At least one of the end of the axle must be rotatably supported by the either the extension arm 110 or the bracket member 112. Due to the coupling of the extension arm 110 with the bracket member 112, the bracket member 112 moves with the bed 16 when it is rotated. Since at least one end of the axle is rotatably supported, the positional change of the bed 16 is transmitted to the bracket member 112 but not the torque. The upper end of the bracket member 112 is attached to the arm support 90 via a bow element 114. Therefore, the rotation of the bed 16 leads to movement of the arm support 90, however, the guide tracks 102, 106 and the coupling via the axle ensure that the arm support 90 remains in the horizontal position.

In order to allow the position of the arm support 90 to be varied relative to the bed 16 for patients of different size, the bracket unit 112 is adjustable. Specifically, the initial position of the arm support 90 for a particular patient may be set through the bracket member 112 via a horizontal carriage 116 and a vertical carriage 118 which are driven by a driving means such as the illustrated electric motor 120. Once this initial setting of the arm support 90 is completed, the bracket member 112 will only move as a unit when the bed 16 is rotated, thereby ensuring that the leveling mechanism keeps the arm support 90 in the horizontal position.

While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and the scope of the invention as defined by the following claims.

What is claimed is:

1. An apparatus for supporting an individual in selectively adjustable orientations, the apparatus comprising;

a base member, a support member pivotally connected to the base member such that the support member is rotatable relative to the base into different orientations, a drive unit disposed to rotate the support member, a control unit in electrical connection with said drive unit disposed to apply control signals to actuate the drive unit such that the orientation of the support member may be selectively adjusted, and a device for measuring a preselected medical characteristic of the individual electrically connected to the control unit and wherein the control unit varies the orientation of the support member according to the measurement of the preselected medical characteristic of the individual, wherein the preselected medical characteristic measured by the measuring device is selected from the group consisting of defined movements, blood pressure, heart rate, brain waves, muscle potentials and blood circulation.

2. The apparatus of claim 1 wherein the drive unit means comprises:

an arcuate-shaped carriage attached to the support member, the arcuate-shaped carriage being coaxial with the pivotal connection of the support member to the base member, a flexible drive belt attached to the carriage such that the drive belt traverses the surface of the carriage, at least one deflection roller arranged adjacent the carriage for engaging the drive belt, and means for rotating the deflection roller.

3. The apparatus of claim 2 wherein the drive unit includes first and second deflection rollers arranged adjacent the carriage, the first and second deflection rollers being spaced at corresponding first and second radial distances from the carriage which are approximately equal and at a distance along the circumferential surface of the carriage from each other, and a third deflection roller disposed between the first and second deflection rollers and spaced a third radial distance from the carriage.

4. The apparatus according to claim 3 wherein the diameters of the first, second and third deflection rollers, the first, second and third radial distances and the circumferential distance between the first and second deflection rollers are selected such that the drive belt is guided over either the first or second deflection roller away from the carriage, around at least a portion of the outer surface of the third deflection roller, and over the other of the first or second deflection roller and back to the carriage.

5. The apparatus according to claim 4 wherein the first, second and third deflection rollers are arranged outboard of the carriage and have approximately equal diameters.

6. The apparatus according to claim 5 wherein the first and second deflection rollers are arranged as close as possible to the carriage.

7. The apparatus according to claim 6 wherein the circumferential distance between the first and second deflection rollers is approximately equal to the diameters of the first, second and third deflection rollers.

8. The apparatus according to claim 7 wherein the third deflection roller is centered relative to the first and second deflection rollers and the third radial distance is greater than the first and second radial distances.

9. The apparatus according to claim 1 further including means for driving the rotation of the third deflection roller.

10. The apparatus according to claim 1 wherein the support member comprises a bed, a head rest and a foot rest.

11. The apparatus according to claim 10 wherein the head rest is pivotally connected to the bed for selective rotation relative to the bed such that the angle of the head rest relative to the bed may be adjusted.

12. The apparatus according to claim 10 wherein the foot rest is connected to the bed such that it is selectively movable in the longitudinal direction relative to the bed.

13. The apparatus according to claim 11 further comprising means for driving the rotation of the head rest relative to the bed.

14. The apparatus according to claim 12 further comprising means for driving the longitudinal movement of the foot rest relative to the bed.

15. The apparatus according to claim 1 further comprising a step support connected to the support member for holding the individual on the support member, the step support being connected to the support member such that it is adjustable in the longitudinal direction relative to support member.

16. The apparatus according to claim 1 further comprising shoulder supports connected to the support member for holding the individual on the support member, the shoulder supports being connected to the support member such that they are adjustable relative to the support member.

17. The apparatus according to claim 1 further comprising arm rests connected to said support member for holding the individual on the support member, the arm rests being connected to the support member such that they extend laterally relative to the support member and are removable.

18. The apparatus according to claim 1 wherein the control unit varies the orientation of the support member according to a predetermined program.

19. The apparatus according to claim 1 wherein the measuring device comprises at least one ultrasound transmitter and at least one ultrasound receiver.

20. An apparatus for supporting an individual in selectively adjustable orientations, the apparatus comprising;

a base member, a support member pivotally connected to the base member such that the support member is rotatable relative to the base into different orientations, a drive unit disposed to rotate the support member, a control unit in electrical connection with said drive unit disposed to apply control signals to actuate the drive unit such that the orientation of the support member may be selectively adjusted, and an arm support and a means connected to the support member for maintaining the arm support in a preselected orientation relative to the support member as the support member rotates relative to the base.

21. The apparatus according to claim 20 wherein the preselected orientation is horizontal.

22. The apparatus according to claim 21 wherein the arm support orientation maintenance means comprises:

a carrying element rigidly connected to the support member, a first axle connected to the arm support and rotatably supported by the carrying element, a first gear wheel attached to the free end of the first axle, a second axle firmly connected to the base, a second gear wheel attached to the free end of the second axle such that the second gear wheel is stationary and coaxial with the pivotal connection of the support member to the base, and a notched drive belt running between the first and second gear wheels.

23. The apparatus according to claim 22 further including a spindle drive attached to the carrying element for adjusting the distance between the first axle and the arm support.

24. The apparatus according to claim 21 wherein the arm support orientation maintenance means comprises:

a first support bracket attached to the arm support and slidably connected to a horizontal guide track, a second support bracket attached to the horizontal guide track and slidably connected to a vertical guide track, an extension arm attached to the support member, an arm support bracket connected to the arm support, and an axle connecting the extension arm to the arm support adjusting unit, at least one end of the axle being rotatably supported by either the extension arm or the arm support bracket.

25. The apparatus according to claim 24 wherein the arm support bracket includes a horizontal carriage and a vertical carriage for adjusting the position of the arm support.

26. The apparatus according to claim 21 wherein the arm support and the arm support orientation maintenance means are disposed on a wheeled trailer such that they can be moved away from the support member.

27. The apparatus of claim 20 wherein the drive unit means comprises:

an arcuate-shaped carriage attached to the support member, the arcuate-shaped carriage being coaxial with the pivotal connection of the support member to the base member, a flexible drive belt attached to the carriage such that the drive belt traverses the surface of the carriage, at least one deflection roller arranged adjacent the carriage for engaging the drive belt, and means for rotating the deflection roller.

28. The apparatus according to claim 20 wherein the support member comprises a bed, a head rest and a foot rest.

29. The apparatus according to claim 20 further comprising a step support connected to the support member for holding the individual on the support member, the step support being connected to the support member such that it is adjustable in the longitudinal direction relative to support member.

30. The apparatus according to claim 20 further comprising shoulder supports connected to the support member for holding the individual on the support member, the shoulder supports being connected to the support member such that they are adjustable relative to the support member.

31. The apparatus according to claim 20 further comprising arm rests connected to said support member for holding the individual on the support member, the arm rests being connected to the support member such that they extend laterally relative to the support member and are removable.

32. The apparatus according to claim 20 further comprising a device for measuring a preselected medical characteristic of the individual electrically connected to the control unit and wherein the control unit varies the orientation of the support member according to the measurement of the preselected medical characteristic of the individual.

* * * * *